US005730709A

United States Patent [19]

Sergent

[11] Patent Number: 5,730,709

[45] Date of Patent: Mar. 24, 1998

[54] SCRATCHING DEVICE FOR A CAST

[76] Inventor: Brandon M. Sergent, 1809 Woodlands Ave., Ashland, Ky. 41101

[21] Appl. No.: 650,777

[22] Filed: May 20, 1996

[51] Int. Cl.[6] ..... A61H 7/00

[52] U.S. Cl. ..... 601/137; 601/136

[58] Field of Search ..... 601/136–138; 446/247

[56] References Cited

U.S. PATENT DOCUMENTS

| | | | |
|---|---|---|---|
| D. 370,729 | 6/1996 | Hurlburt et al. | D24/133 |
| 1,942,768 | 1/1934 | O'neil | 446/247 |
| 1,953,565 | 8/1934 | O'neil | 446/247 |
| 2,711,731 | 6/1955 | Krohne | 601/137 |
| 3,527,208 | 9/1970 | Hoegerman | 601/136 |
| 3,867,931 | 2/1975 | Babka | 602/9 |
| 4,667,659 | 5/1987 | Hayday | 601/137 |
| 4,892,091 | 1/1990 | Sullenger | 601/137 |
| 4,945,903 | 8/1990 | Alper | 601/137 |

*Primary Examiner*—Robert A. Hafer
*Assistant Examiner*—Benjamin K. Koo

[57] ABSTRACT

A scratching device including a length of cord arranged in a circular configuration. The length of cord extends between a cast and a limb in a continuous orientation. The length of cord has a plurality of knots formed thereon spaced equally apart from one another. The cord is adapted to pulled within the cast to relieve irritating skin beneath the cast.

5 Claims, 3 Drawing Sheets

FIG 1
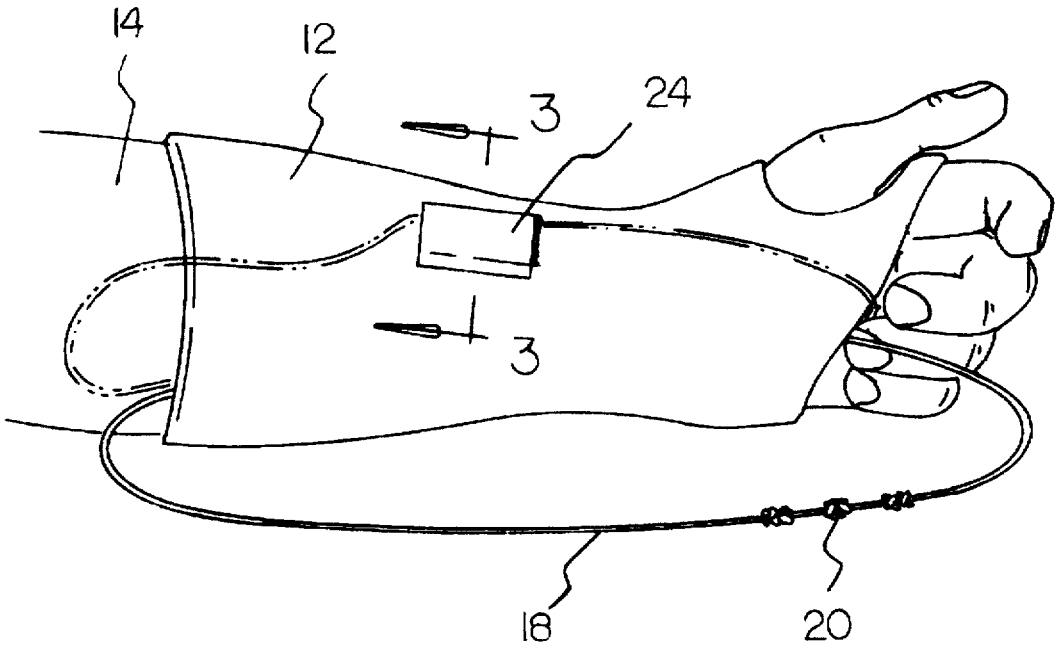
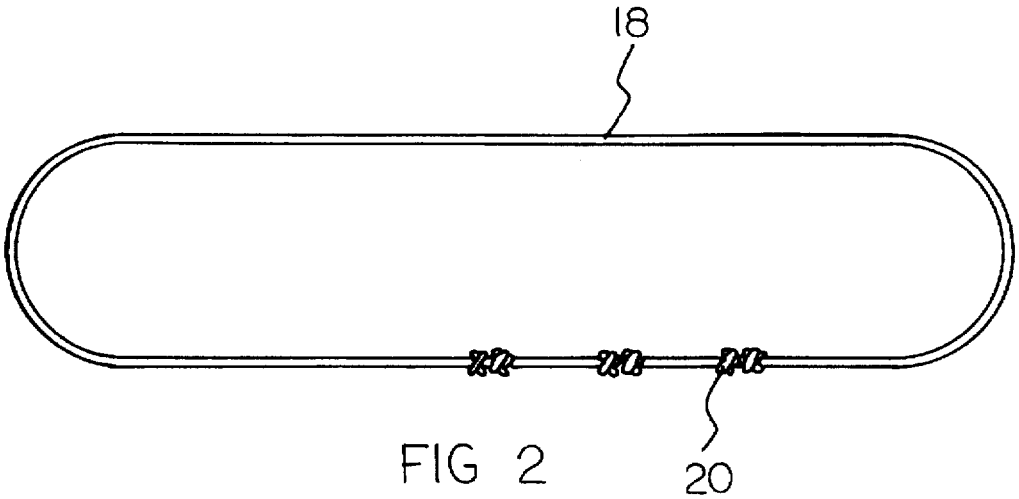
FIG 2

SCRATCHING DEVICE FOR A CAST

BACKGROUND OF THE INVENTION

1. Field of the Invention

The present invention relates to a scratching device and more particularly pertains to providing relief for itching skin underneath a cast with a scratching device.

2. Description of the Prior Art

The use of massaging devices is known in the prior art. More specifically, massaging devices heretofore devised and utilized for the purpose of massaging a skin surface are known to consist basically of familiar, expected and obvious structural configurations, notwithstanding the myriad of designs encompassed by the crowded prior art which have been developed for the fulfillment of countless objectives and requirements.

By way of example, U.S. Pat. No. 5,016,619to Fitzpatrick discloses a massaging device.

U.S. Pat. No. 4,667,659 to Hayday discloses a massaging device for massaging skin inside a cast, splint or the like.

U.S. Pat. No. Des. 342,999 to Gonsalves, Jr. discloses the ornamental design for a massager.

U.S. Pat. No. 4,945,903 to Alper discloses an anti-itch cast.

U.S. Pat. No. 4,308,862 to Kalmar discloses a plaster cast.

U.S. Pat. No. 5,098,693 to Faas, Jr. et al. discloses an anti-irritant for use with cast and method of application.

While these devices fulfill their respective, particular objective and requirements, the aforementioned patents do not describe a scratching device for providing relief for itching skin underneath a cast.

In this respect, the scratching device according to the present invention substantially departs from the conventional concepts and designs of the prior art, and in doing so provides an apparatus primarily developed for the purpose of providing relief for itching skin underneath a cast.

Therefore, it can be appreciated that there exists a continuing need for new and improved scratching device which can be used for providing relief for itching skin underneath a cast. In this regard, the present invention substantially fulfills this need.

SUMMARY OF THE INVENTION

In the view of the foregoing disadvantages inherent in the known types of massaging devices now present in the prior art, the present invention provides an improved scratching device. As such, the general purpose of the present invention, which will be described subsequently in greater detail, is to provide a new and improved scratching device and method which has all the advantages of the prior art and none of the disadvantages.

To attain this, the present invention essentially comprises a cast positionable on a limb of a person having a broken bone. A space of air is disposed between the cast and the limb. A length of cord is included and arranged in a circular configuration. The length of cord extends through the space of air disposed between the cast and the limb in a continuous orientation. The length of cord has a plurality of knots formed thereon spaced equally apart from one another. The device includes a storage portion comprised of a planar member having an upper portion, a lower portion and a fold line therebetween. The storage portion further has an inner surface and an outer surface. The inner surface of the storage portion has an adhesive disposed on the lower portion thereof. The adhesive couples the storage portion to the cast. The outer surface of the storage portion has pile type fasteners disposed on the upper portion and the lower portion thereof. The storage portion receives a segment of the cord in the fold line with the pile type fasteners of the upper and lower portions coupled together thereover.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved scratching device which has all the advantages of the prior art massaging devices and none of the disadvantages.

It is another object of the present invention to provide a new and improved scratching device which may be easily and efficiently manufactured and marketed.

It is a further object of the present invention to provide a new and improved scratching device which is of durable and reliable construction.

An even further object of the present invention is to provide a new and improved scratching device which is susceptible of a low cost of manufacture with regard to both materials and labor, and which accordingly is then susceptible of low prices of sale to the consuming public, thereby making such a scratching device economically available to the buying public.

Still yet another object of the present invention is to provide a new and improved scratching device which provides in the apparatuses and methods of the prior art some of the advantages thereof, while simultaneously overcoming some of the disadvantages normally associated therewith.

Even still another object of the present invention is to provide a new and improved scratching device for providing relief for itching skin underneath a cast.

Lastly, it is an object of the present invention to provide a new and improved scratching device including a length of cord arranged in a circular configuration. The length of cord extends between a cast and a limb in a continuous orientation. The length of cord has a plurality of knots formed thereon spaced equally apart from one another. The cord is adapted to pulled within the cast to relieve irritating skin beneath the cast.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a perspective view of the preferred embodiment of the scratching device constructed in accordance with the principles of the present invention.

FIG. 2 is a plan view of the cord of the present invention.

The same reference numerals refer to the same parts through the various Figures.

DESCRIPTION OF THE PREFERRED EMBODIMENT

Figure 3:
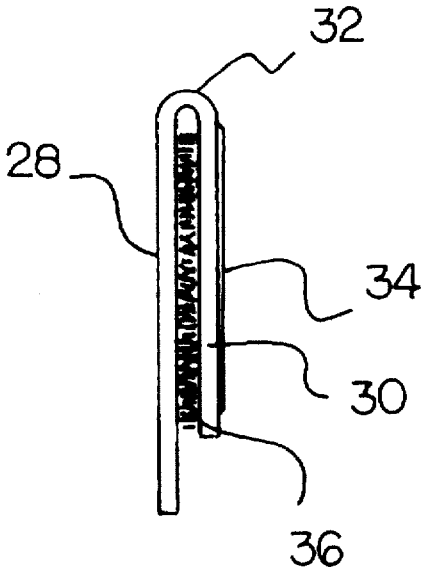
FIG. 3 is a cross-sectional view as taken along line 3—3 of FIG. 1.
Figure 4:
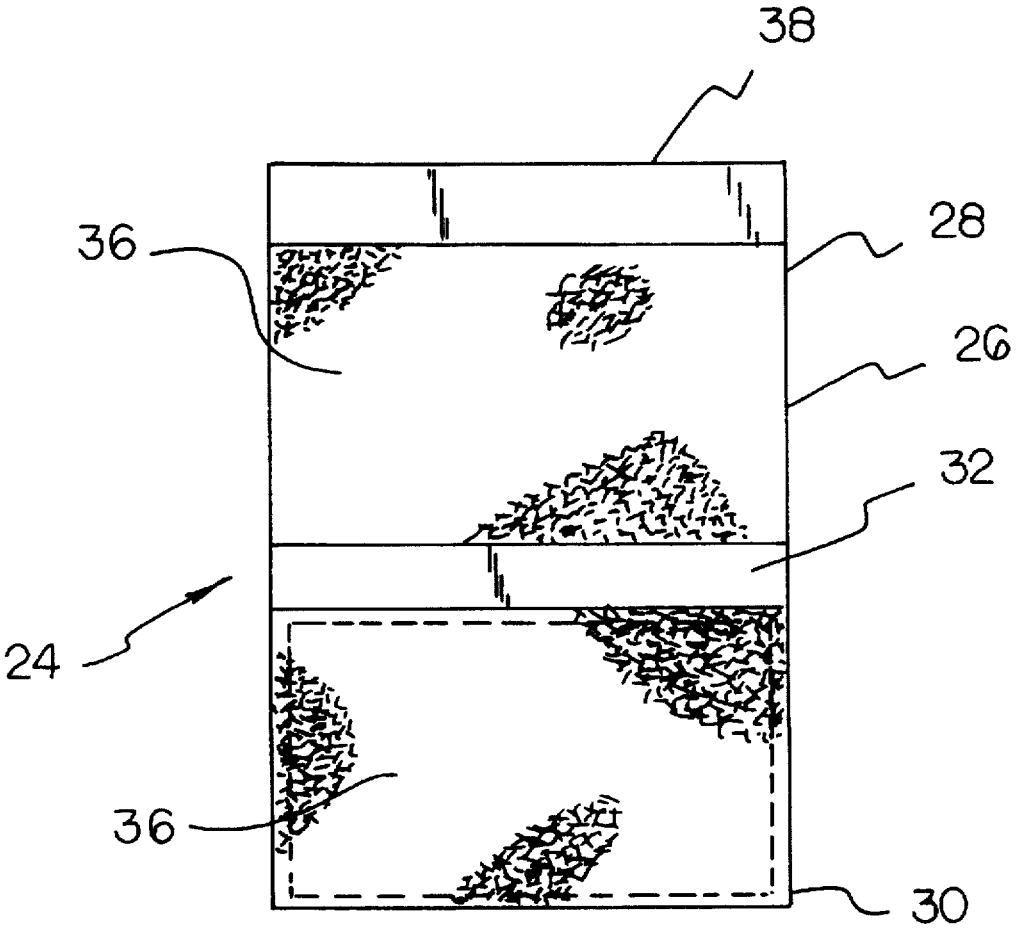
FIG. 4 is a plan view of the storage portion of the present invention.
Figure 5:
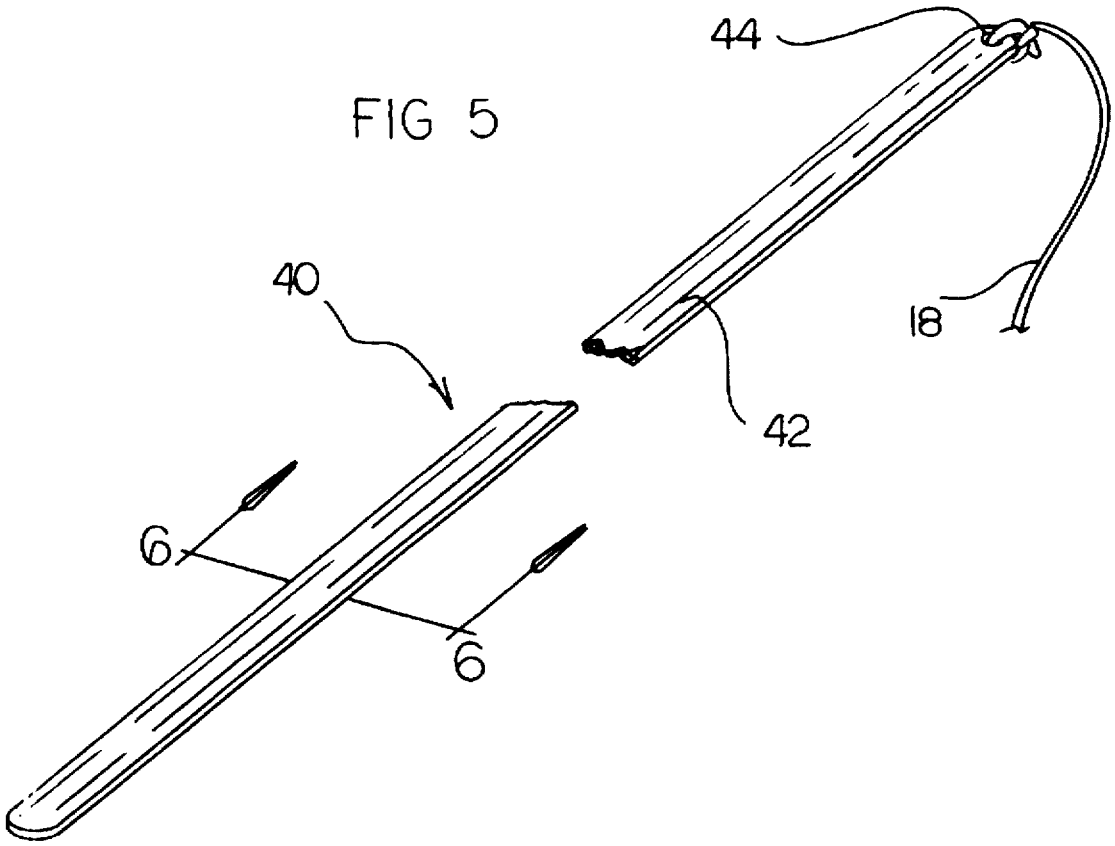
FIG. 5 is a perspective view of the feeder tool of the present invention.
Figure 6:
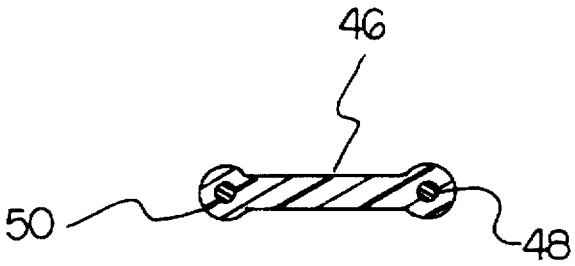
FIG. 6 is a cross-sectional view as taken along line 6—6 of FIG. 5.

With reference now to the drawings, and in particular, to FIGS. 1–6 thereof, the preferred embodiment of the new and improved scratching device embodying the principles and concepts of the present invention and generally designated by the reference number 10 will be described.

Specifically, it will be noted in the various Figures that the device relates to a scratching device for providing relief for itching skin underneath a cast. In its broadest context, the device consists of a cast, a cord and a storage portion. Such components are individually configured and correlated with respect to each other so as to attain the desired objective.

The device 10 includes a cast 12 positionable on a limb 14 of a person having a broken bone. A space of air is disposed between the cast 12 and the limb 14.

A length of cord 18 is included and arranged in a circular configuration. The length of cord 18 extends through the space of air disposed between the cast 12 and the limb 14 in a continuous orientation. The length of cord 18 has a plurality of knots 20 formed thereon spaced equally apart from one another. The length of cord 18 is preferably positioned within the cast 12 as the cast is being applied. The length of cord is 2½ to 3 times the length of the cast 12. The length of cord is tied in place after the cast 12 is applied to form the circular configuration. The plurality of knots 20 serve to contact the irritating skin area to provide relief therefrom.

The device 10 also includes a storage portion 24 comprised of a planar member 26 having an upper portion 28, a lower portion 30 and a fold line 32 therebetween. The storage portion 24 further has an inner surface and an outer surface. The inner surface of the storage portion 24 has an adhesive 34 disposed on the lower portion 30 thereof. The adhesive 34 couples the storage portion 24 to the cast 12. The outer surface of the storage portion 24 has pile type fasteners 36 disposed on the upper portion 28 and the lower portion 30 thereof. The storage portion 24 receives a segment of the cord 18 in the fold line 32 with the pile type fasteners 36 of the upper and lower portions 28, 30 coupled together thereover. The storage portion 24 will couple over the cord 18 to keep the cord 18 out of the way when not in use. A tab 38 extends upwardly from the upper portion 28 to allow for the user to pull apart the coupled together pile type fasteners 36 for access to the length of cord 18.

A feeder tool 40 can also be included in the device 10. The feeder tool 40 directs the length of cord 18 between the cast 12 and the limb 14. The feeder tool 40 comprises an elongated member 42 having an aperture 44 through one end thereof. The aperture 44 receives the cord 18 therethrough. The elongated member 42 is comprised of a planar plastic member 46. The elongated member 42 further comprises wire members 48 extending along opposing long side edges 50 of the planar plastic member 46. The feeder tool 40 is used when an existing cast is in place. The user simply feeds the cord through the aperture 44 and ties a small knot. The feeder tool 40 is then threaded between the cast and the limb whereupon the cord 18 in untied from the feeder tool 40 and tied in the plurality of knots 20 for use.

The present invention is designed for fracture patients. The device 10 provides a gentle, effective, welcome means to scratch beneath the cast 12.

The present invention consists of a length of medically approved light cotton or synthetic cord. Three double knots are placed in the cord 18. The storage portion 24 with peel-n-stick adhesive backing completes the device 10.

The pull tab 38 is suitable for imprint with advertising. The device 10 is not intended for use on broken skin. The device 10 further discourages frustrated patients from inserting foreign objects beneath the cast—pencils, sticks, coat hangers, etc.—and damaging the skin. The device 10 also encourages patients to wear the cast for the proper length of time.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters Patent of the United States is as follows:

1. A scratching device for providing relief for itching skin underneath a cast comprising, in combination:

a cast positionable on a limb of a person having a broken bone, a space of air disposed between the cast and the limb;

a length of cord arranged in a circular configuration, the length of cord extending through the space of air disposed between the cast and the limb in a continuous orientation, the length of cord having a plurality of knots formed thereon in a spaced relationship; and a storage portion comprised of a planar member having an upper portion, a lower portion and a fold line therebetween, the storage portion further having an inner surface and an outer surface, the inner surface of the storage portion having an adhesive disposed on the lower portion thereof, the adhesive coupling the storage portion to the cast, the outer surface of the storage portion having pile type fasteners disposed on the upper portion and the lower portion thereof, the storage portion receiving a segment of the cord in the fold line with the pile type fasteners of the upper and lower portions coupled together thereover.

2. A scratching device comprising:

a cast adapted to be positioned about a broken limb; and a length of cord arranged in a circular configuration, the length of cord adapted to extend between the cast and the broken limb in a continuous orientation, the length of cord having a plurality of knots formed thereon in a spaced relationship.

3. The scratching device as set forth in claim 2 and further including a storage portion comprised of a planar member having an upper portion, a lower portion and a fold line therebetween, the storage portion further having an inner surface and an outer surface, the inner surface of the storage portion having an adhesive disposed on the lower portion thereof, the adhesive coupling the storage portion to the cast, the outer surface of the storage portion having pile type fasteners disposed on the upper portion and the lower portion thereof, the storage portion receiving a segment of the cord in the fold line with the pile type fasteners of the upper and lower portions coupled together thereover.

4. The scratching device as set forth in claim 2 and further including a feeder tool for directing the length of cord between the cast and the limb.

5. The scratching device as set forth in claim 4 wherein the feeder tool comprising an elongated member having an aperture through one end thereof, the aperture receiving the cord therethrough, the elongated member comprised of a planar plastic member, the elongated member further comprising wire members extending along opposing long side edges of the planar plastic member.

* * * * *